US005302205A

United States Patent [19]

Priddy

[11] Patent Number: 5,302,205

[45] Date of Patent: Apr. 12, 1994

[54] NAIL HOLE FILLER

[76] Inventor: Robert V. Priddy, 504 N. Central, Cushing, Okla. 74023

[21] Appl. No.: 944,667

[22] Filed: Sep. 14, 1992

[51] Int. Cl.[5] ..... B05C 17/06

[52] U.S. Cl. ..... 118/406; 118/213; 118/504; 425/87; 425/458; 401/266

[58] Field of Search ..... 118/211, 213, 301, 260, 118/406, 206, 504; 425/87, 458; 401/261, 266, 265, 21, 26

[56] References Cited

U.S. PATENT DOCUMENTS

| | | | |
|---|---|---|---|
| 1,851,497 | 3/1932 | Darling | 118/504 |
| 2,212,073 | 8/1940 | Orth | 118/504 |
| 2,698,002 | 12/1954 | Thoss | 118/504 |
| 2,809,513 | 10/1957 | Ames | 425/87 |
| 3,368,234 | 2/1968 | Edens, Jr. | 425/87 |
| 3,688,740 | 9/1972 | Gesche | 118/504 |
| 4,323,593 | 4/1982 | Tsunashima | 118/504 |

*Primary Examiner*—Michael W. Ball
*Assistant Examiner*—Francis J. Lorin
*Attorney, Agent, or Firm*—Robert E. Massa

[57] ABSTRACT

A tool for guiding filler material, such as caulking or putty, into a nail hole or similar opening in a structure so that a smooth, unblemished finished surface may be obtained. The tool comprises a thin plate having a plurality of holes therethrough, the holes being of different diameters; and a handle attached to one end of the plate. In use, the plate is positioned so that a hole in the plate is aligned with a nail hole and filler material is urged through the hole in the plate to fill the nail hole. The handle is oriented at a low angle in relation to the plate so that the user may rest his hand on the structure to steady the tool while guiding filler material into an opening. The holes are of different diameter to provide a hole which may be of substantially the same diameter as the nail hole being filled. The holes are perpendicular to a tangential surface have a wider diameter at the bottom of the plate than at the top of the plate. The plate may be flat, convex, or concave, in order to accomodate corresponding surfaces of the structure having the nail holes.

6 Claims, 4 Drawing Sheets

NAIL HOLE FILLER

FIELD OF THE INVENTION

My invention relates to tools. More particularly, my invention relates to hand tools for guiding filler material into a nail hole or similar opening in a structure. Still more particularly, my invention relates to a hand tool provided with a small hole through which filler material may be guided into a nail hole in a structure. Still more particularly, my invention relates to a hand tool provided with a plurality of guiding holes through which filler material may be guided into a nail hole of related size to a selected hole in the tool.

BACKGROUND OF THE INVENTION

The construction of wood structures, such as furniture or building components, usually involves the use of nails, screws, or nuts and bolts for securing various portions in position. The finished product may then result in the appearance of unsightly and undesirable depressions which are usually preferably treated in some manner to present a more attractive appearance.

For example, a depression formed in a wooden construction, furniture or carpentry, after some components have been nailed together and the nails have been countersunk, or secured together by wood screws, has traditionally been filled in for concealment by the spreading of wood filler, putty, or caulking material over the depression with a putty knife. The spreading of filler material in this manner invariably results in the unsightly spreading of filler material over a wide area around the depression. Usually, and depending greatly upon the type of wood and filler material used, some of the constituents of the filler material will react with constituents of the wood to give a sullied and smeared appearance to the surface of the wood. The smeared surface then requires a great deal of treatment, usually by sanding over a very wide area, before the surface will again be presentable.

Usually, a carpenter or cabinetmaker will countersink a nail, or drill a beveled hole before attaching a screw. Then, after the nail or screw is secured, a small space remains between the top of the nail or screw and the level surface of the wood structure. The carpenter or cabinetmaker fills in this depression with some type of filler material, initially slightly higher than the surrounding surface. After the filler material dries, the woodworker sands the surface smooth and clean. As described above, the traditional procedure is to sand the entire surface in order to achieve a uniform surface.

In fairly recent times, various tools have been developed for guiding a paint material or filler material along and into chosen surfaces and depressions of a structure. I have found in the prior art the following U.S. patents for various guiding tools:

| | | |
|---|---|---|
| U.S. Pat. No. 1,851,497 | Darling | March 29, 1932 |
| U.S. Pat. No. 2,212,073 | Orth | Aug. 20, 1940 |
| U.S. Pat. No. 2,698,002 | Thoss | Dec. 28, 1954 |
| U.S. Pat. No. 4,323,593 | Tsunashima | April 6, 1982 |

SUMMARY OF THE INVENTION

The primary object of my invention is to provide a tool for guiding a filler material into an opening in a structure which is easy to use and which will provide a means for efficiently acquiring a smooth finished surface on a structure.

Another object of my invention is to provide a tool for guiding a filler material into opening of various diameters of a structure.

Still another object of my invention is to provide a tool of this type which easily and quickly presents guides of various sizes through which filler material may be easily directed into openings of related sizes on a structure.

Still another object of my invention is to provide a tool of this type which includes guide openings for filler material in a manner that the guide openings may be closely and efficiently aligned with openings in a structure.

Still another object of my invention is to provide a tool of this type which may be closely positioned against a structure having openings which are to be filled with filler material, and in which close positioning the tool will have guide openings effectively aligned with openings of related size in the structure.

Still another object of my invention is to provide a tool of this type which is inexpensive, simple to construct, and sturdy in use.

I have devoted a great deal of time to the woodworking craft, and the finishing of wood structures and items, and have become aware of certain features of wood finishing operations which have seemed inadequate. Certain procedures are inadequate because of the need to spend excessive amounts of time and effort in accomplishing these certain procedures.

As I mentioned above, the finishing of wood items by filling in nail holes to give a smooth, neat surface always required a great deal of extra sanding time and care.

I have developed my tool for guiding filler material into such depressions as are remaining after the countersinking of nails to now provide a means for finishing a wood surface with a minimum amount of time and effort while achieving a surface which is probably of better appearance than could have been obtained by traditional methods.

I have also designed my tool for guiding filler material into these types of depressions to overcome another result that I have noticed when certain types of filler material are used. Certain types of filler material shrink as they dry. Occasionally, when the woodworker smears only a small amount of filler material into a depression, using only a putty knife, to make the surface of the filled depression even with the surrounding wood surface while the filler material is wet, then the filler material shrinks as it dries and develops a small depression of its own.

With my device, I am able to provide a small excess of filler material immediately over the nail hole. The dried material is then easily brought to a level with the surrounding wood, preferably by just a small amount of sanding. The amount of sanding may be easily controlled by the woodworker to remove the small excess of dried material and not to mar any wood surface in the surrounding area.

I am showing my tool for guiding material as including a plurality of holes, each of slightly different sizes through the basic thin plate. In this manner, as the woodworker is using my device, he may quickly and easily maneuver the device to select a hole in the tool most properly corresponding to the diameter of the opening in the material he is finishing.

I have designed my device for performing a diversity of filling operations. For example, besides having a plurality of holes for easy correspondence with various openings in the woodwork, I have prepared guides of different geometry for most efficient use with structures of varying design. I am including guides for flat, concave, or convex woodwork. In carpentry, I am including the filling of nail holes in flat molding, quarter-rounds, and concave members.

I prefer to prepare my tool for guiding filler material either of a thin plate of plastic or thin plate of stainless steel. I prefer plastic because the usual filler material is not as likely to adhere to plastic as it would to stainless steel, and, consequently, the filler material may be much more efficiently forced through the holes in plastic and into the openings of woodwork and, after use, the tool could be cleaned much more easily.

A typical guiding tool, whether plastic or steel, would be a plate about 0.017 to 0.02 inches in thickness, with a plurality of holes therethrough, each hole perpendicular to the surface of the tool, and, for example, of from $\frac{1}{8}$ inch diameter to $\frac{5}{8}$ inch diameter. Of course, there may be tools prepared with other diameters, diameters to fit the particular circumstances. Also, I prefer that the holes should each be prepared with a tapered, or slightly conical shape. For instance, a hole having a diameter of 3/16 inch on one side of the plate should taper to a diameter of approximately 5/32 inch on the opposite side of the plate. To greatly facilitate the release of filler material from the tool as the tool is lifted, the tool should have the hole of larger diameter on the lower surface of the plate.

The woodworker may easily remove any filler material remaining in the hole of the tool by pushing a nail or nail punch through the hole whenever it should be necessary to clean the tool.

Also, on a flat type plate, I have preferred designs for two types of small tools: one type having dimensions of about $2\frac{1}{4}$ inches wide and $2\frac{3}{4}$ inches long, and having two rows of holes; and a smaller, narrower type having dimensions of about $\frac{1}{2}$ inch wide and $2\frac{3}{4}$ inches long, and having one row of holes. Thus, I may provide for the type of tool most suitable for the kind of work involved.

I have provided for typical examples of convex and concave types of my tools to be approximately $\frac{1}{2}$ inch wide and $2\frac{3}{4}$ inches long and preferably with one row of holes suited to the type of work to be done.

In use, I place a tool on the work in a manner that a hole of the tool is properly axially aligned with an opening of substantially similar diameter in the work structure and place some filler material on the plate so that I may then very simply and easily force filler material through the hole of the tool and into the opening of the work structure by a putty knife or other device. I carefully remove the tool from the work structure so that a slight excess of filler material remains on the work over the opening in the structure. After the filler material has dried, it is then a very simple matter to sand the excess of filler material from the work. Depending upon the type of work and filler material being used, I have designed a tool having a small vertical ridge around the upper surface of the tool which serves to retain filler material upon the upper surface during use.

I have also observed and provided that the thickness of the plate of my tool is related to the amount of excess filler material which is desired to be left on the work structure after a nail hole or similar opening is filled.

In summary, my tool for guiding a filler material into an opening in a structure comprises a thin plate with the plate having a plurality of openings, each of different diameter, and a handle attached at one end of the plate with the handle oriented at a low angle in relation to the plate so that a user may rest his hand holding the tool on the structure to steady the tool while guiding filler material.

The objects and advantages of my invention will become apparent from my description of the following preferred embodiments of my invention.

DESCRIPTION OF THE PREFERRED EMBODIMENTS

Figure 1:
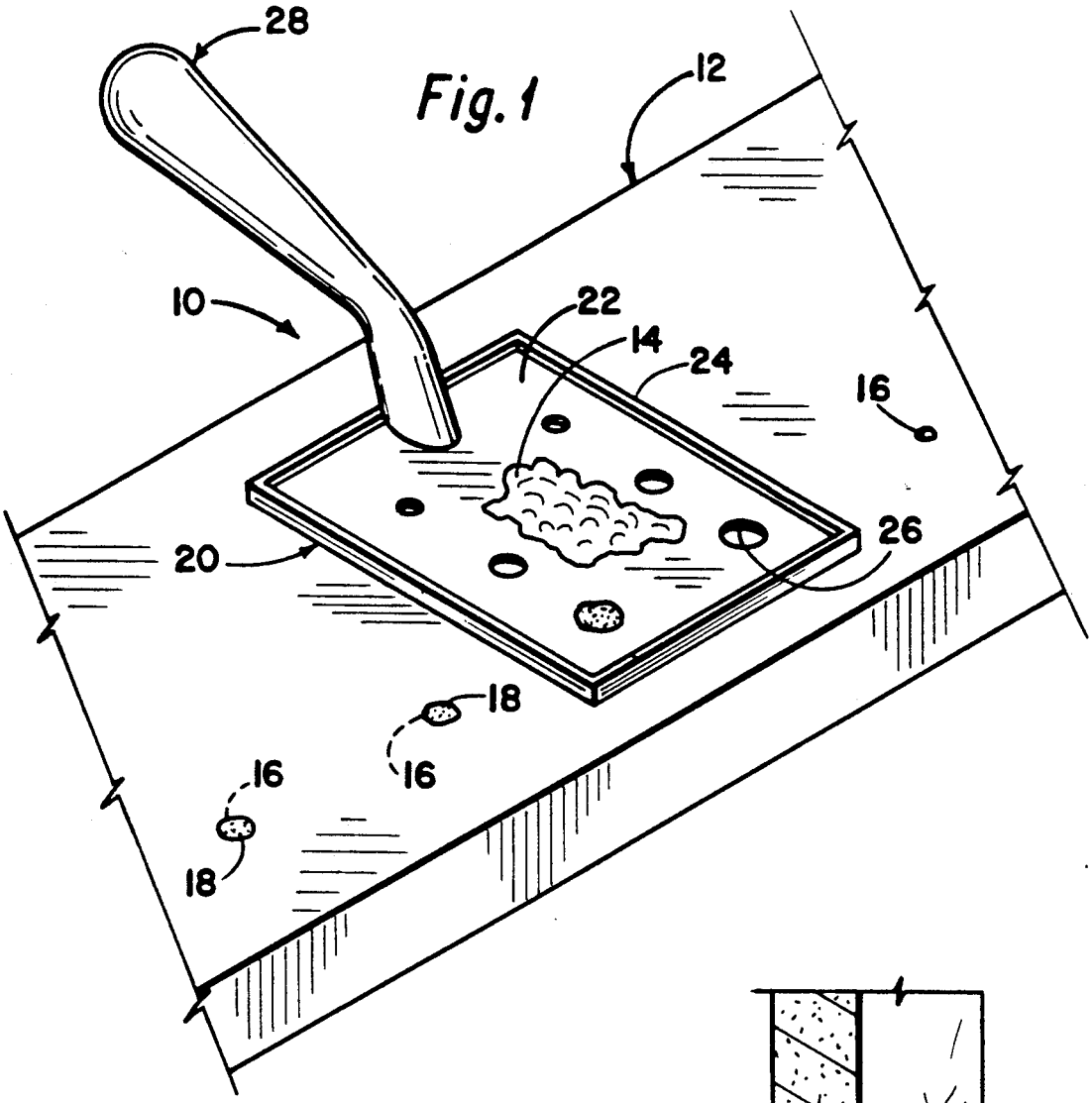
FIG. 1 is a perspective view of one embodiment of my tool for guiding filler material into an opening of a structure as the tool would be operated in one form of use.

FIG. 1 is a perspective view of a tool for guiding filler material 10, generally, according to my invention, as it would be positioned in a chosen working position upon a wood structure 12, generally, in working condition for forcing filler material, as described by a clump of filler material 14 and the various openings 16, which may be nail holes in the wood structure 12. As shown in FIG. 1, an opening 16, referred to by dotted lines, has already been filled with filler material and a typical excess of filler material 18 remains after the tool 10 has been moved away from the filled opening. The excess filler material 18 is allowed to dry and may be carefully sanded smoothly to the level of the surrounding wood structure.

As shown, the tool 10 comprises a flat plate member 20, generally, which includes a flat member 22 surrounded by ridged components 24 and having a plurality of holes of different diameters 26 which are tapered as described above. The tool 10 has attached thereto a handle 28, which is preferably attached at a suitable angle to permit the user to rest his hand on the wood structure 12 for supporting the tool 10 easily and steadily while working as I show in FIG. 2.

Figure 3:
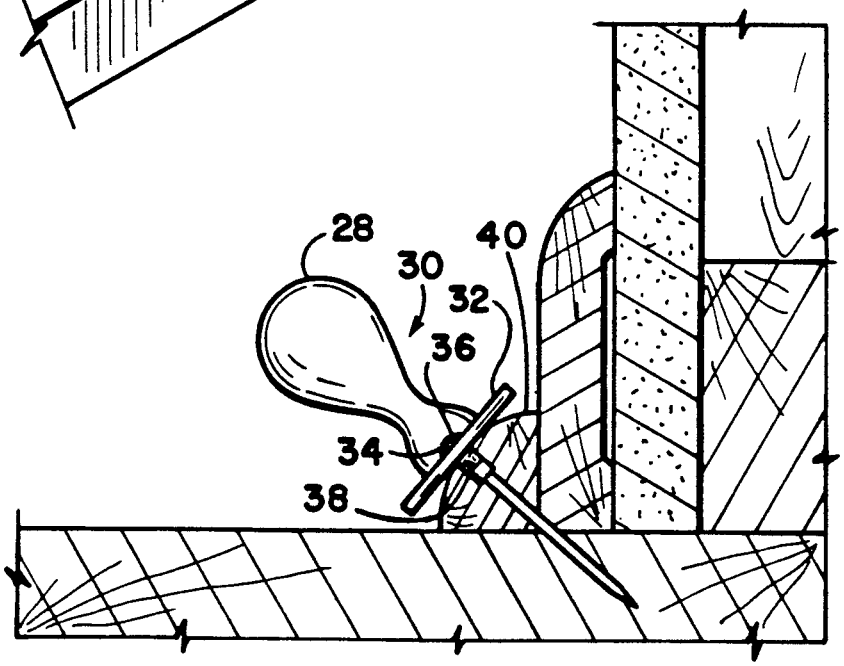
FIG. 3 is a front elevational view of a second embodiment of my tool for guiding filler material according to my invention as the tool would be oriented upon a particular wood structure which is shown in sectional view.

In FIG. 3 I show a front elevational view of a second embodiment of my invention, which is somewhat related to the tool 10 of FIG. 1. In FIG. 3 my tool 30, generally, includes a flat plate member 32 which has a single row of holes 34. Plate 32, for some purposes, is more effectively used without the ridged sides on the plate as shown in FIG. 1. In FIG. 3 the tool has been used for forcing filler material 36 into nail holes 38 in a quarter round 40.

Figure 4:
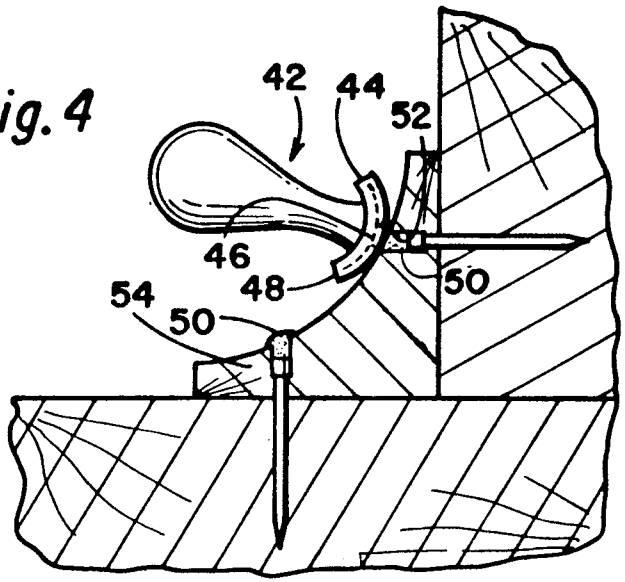
FIG. 4 is a front elevational view of a third embodiment of my tool, a concave plate type, for guiding filler material according to my invention as the tool would be oriented upon another particular type of wood structure which is shown in sectional view.
Figure 5:
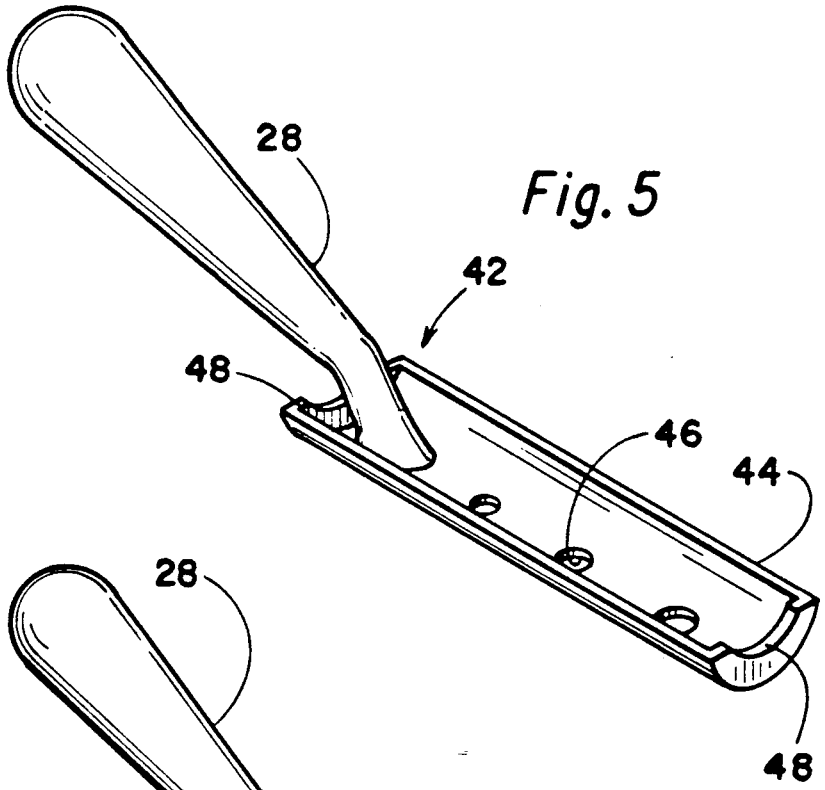
FIG. 5 is a perspective view of the third embodiment of my tool shown in FIG. 4.

FIG. 4 is a front elevational view of a third embodiment of my invention, which I also show in a perspective view of FIG. 5. In FIG. 4 my tool 42, generally, includes a concave plate member 44 which has a single row of holes 46 and end ridges 48. Again, as above, the tool 42 has been used for forcing filler material 50 into nail holes 52 in a concave molding or cavetto 54.

Figure 6:
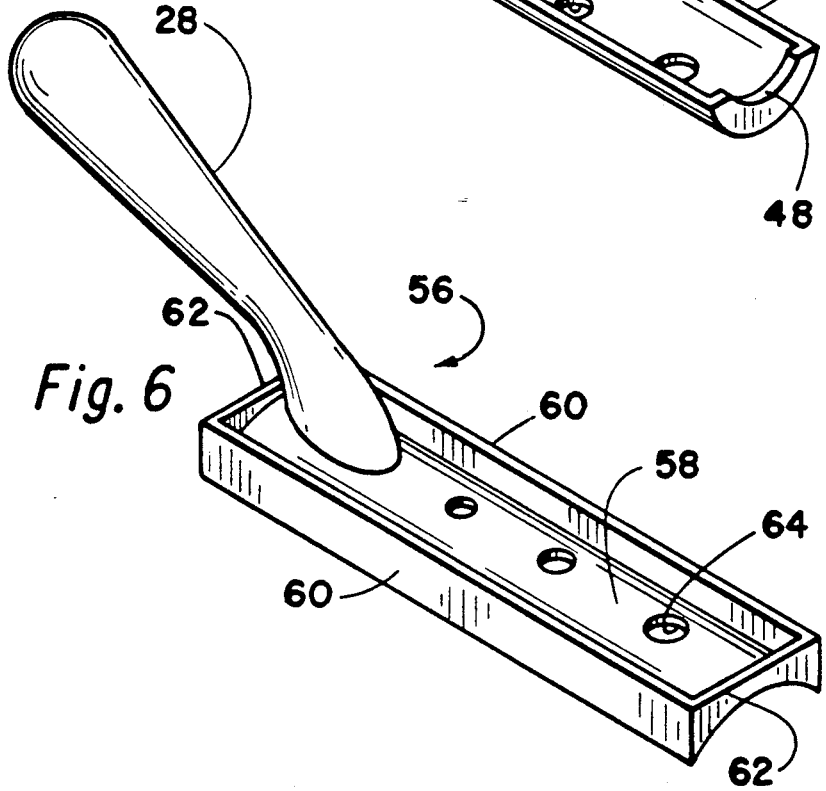
FIG. 6 is a perspective view of a fourth embodiment of my tool, a convex plate type, for guiding filler material according to my invention.

FIG. 6 is a perspective view of a convex type tool 56, generally, having a convex plate 58 surrounded by side ridge members 60 and end ridge members 62 and including a single row of holes 64. The tool 56 is, of course, ideal for forcing filler material into nail holes in a convex type molding.

Figure 2:
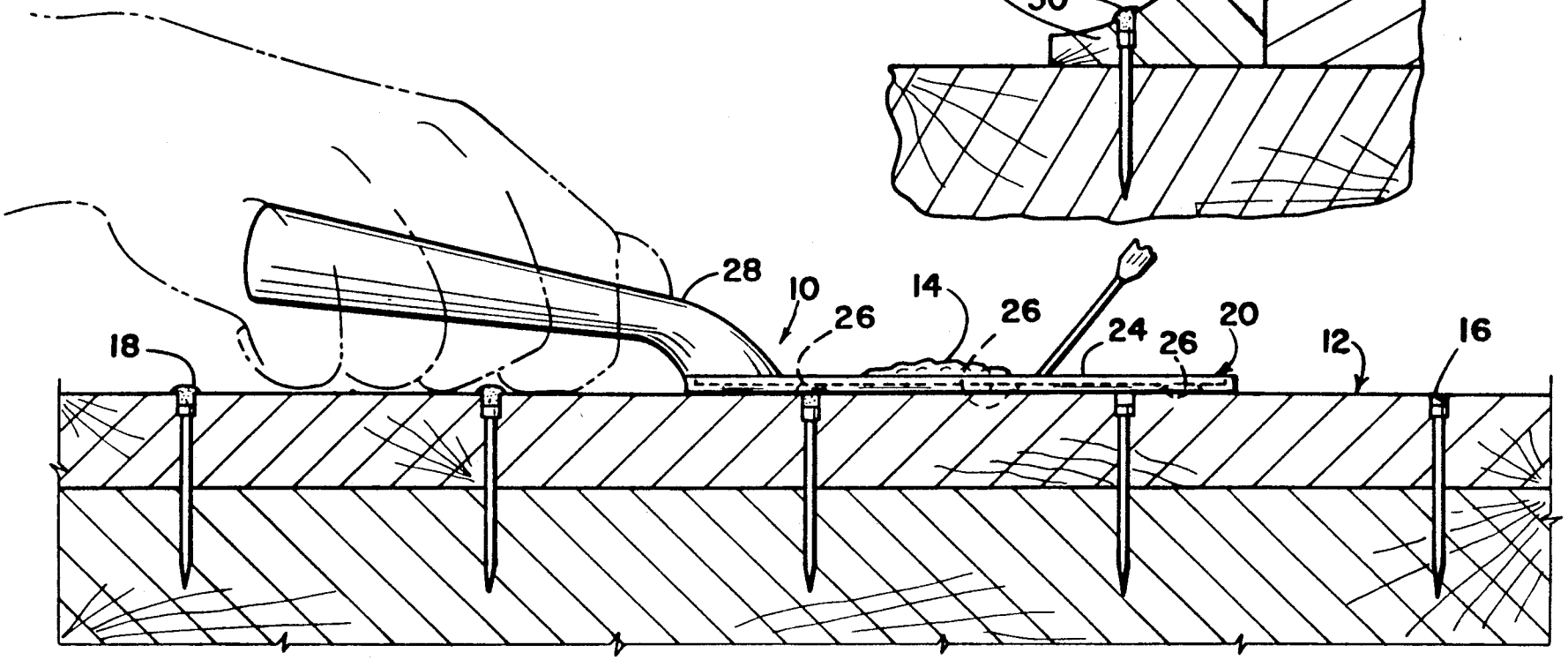
FIG. 2 is a side elevational view of the embodiment described in FIG. 1 as the tool would be held in position and showing an operator's hand in shadow as the hand and handle would be oriented according to my invention.
Figure 7:
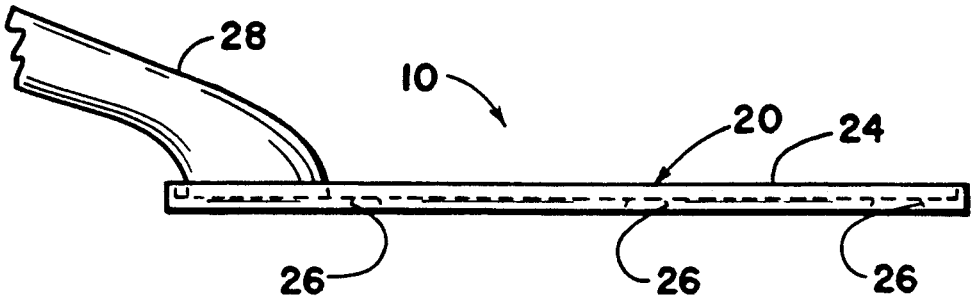
FIG. 7 is a fragmentary side elevational view of a tool according to my invention similar to the embodiment shown in FIG. 2.

FIG. 7 is a fragmentary side elevational view of a tool 10, as shown in FIGS. 1 and 2, for the purpose of showing the arrangement of the holes 26.

Figure 8:
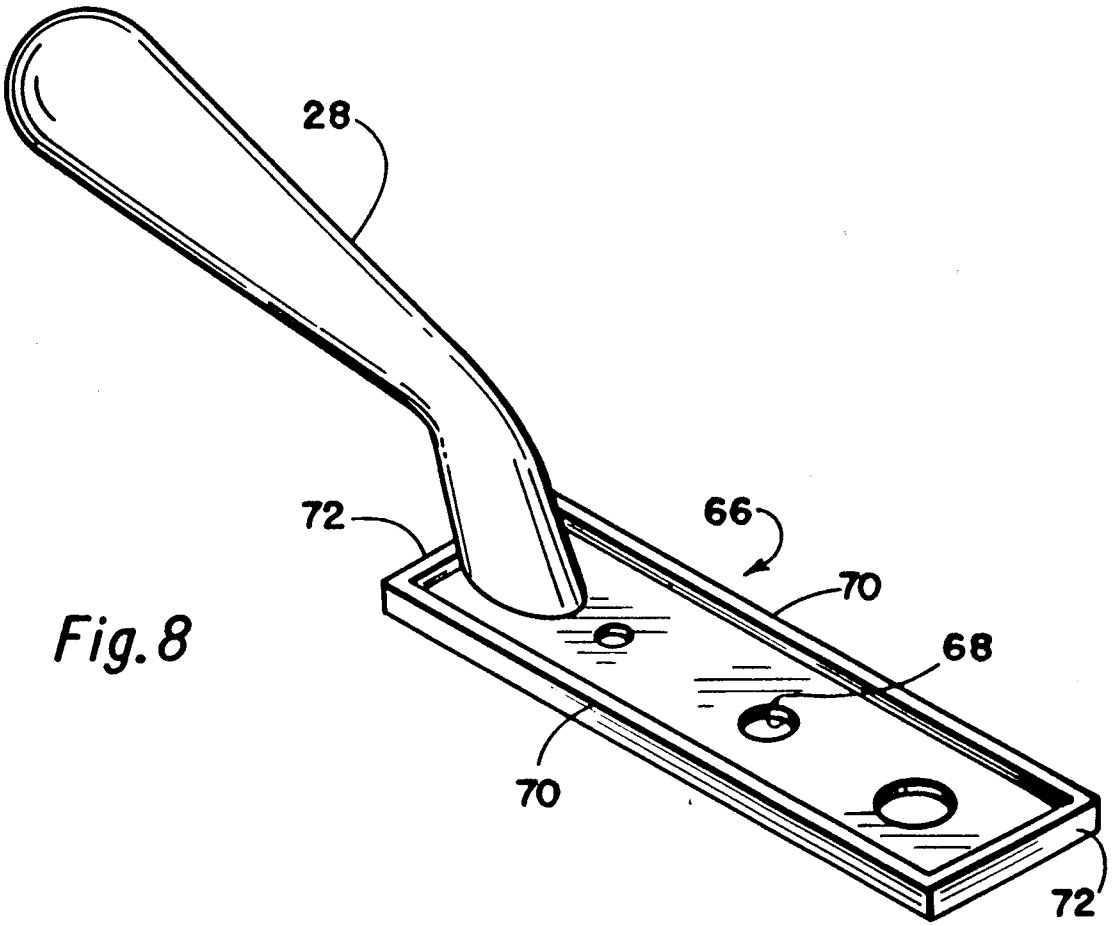
FIG. 8 is a perspective view of a fifth embodiment of a tool according to my invention similar to the tool described in FIG. 1.

FIG. 8 describes a flat type tool 66, generally, somewhat similar to the tool 10 shown in FIG. 1, but having only a single row of holes 68 in order to have a more narrow tool which would permit usage in smaller, more cramped areas. I show in FIG. 8 that the tool 66 also includes side ridge members 70 and end ridge members 72.

Since many different embodiments of my invention may be made without departing from the spirit and scope thereof, it is to be understood that the specific embodiments described in detail herein are not to be taken in a limiting sense, since the scope of the invention is best defined by the appended claims.

I claim:

1. A tool for guiding a filler material into an opening in a structure comprising:
- a thin plate having a plurality of holes therethrough, with each hole of a different diameter,
- the plate is substantially rectangular,
- a handle attached at one end of the plate,
  - the handle oriented at a low angle in relation to the plate so that a user may rest a hand member on the structure to steady the tool while guiding filler material,
- the holes arranged in a row longitudinally of the plate, and
- the holes are axially perpendicular to the plate and have a wider diameter at the bottom of the plate than at the top of the plate.

2. A tool for guiding a filler material into an opening as described in claim 1, wherein
- a row of holes includes a smallest hole near a first end of the plate and progressively larger holes toward a second end of the plate.

3. A tool for guiding a filler material into an opening in a structure comprising:
- a thin plate having a plurality of holes therethrough, with each hole of a different diameter,
- a handle attached at one end of the plate,
  - the handle oriented at a low angle in relation to the plate so that a user may rest a hand member on the structure to steady the tool while guiding filler material,
- the plate includes a portion which is curved in the longitudinal direction of the tool to permit positioning of the tool on a curved surface during use,
- the portion of the plate which is curved in the longitudinal direction of the tool is substantially concave in relation to the position of the handle,
- the holes are arranged in a row longitudinally of the plate, and
- the holes are axially perpendicular to a tangential surface of the plate and have a wider diameter at the bottom of the plate than at the top of the plate.

4. A tool for guiding a filler material into an opening as described in claim 3, wherein
- a row of holes includes a smallest hole near a first end of the plate and progressively larger holes toward a second end of the plate.

5. A tool for guiding a filler material into an opening in a structure comprising:
- a thin plate having a plurality of holes therethrough, with each hole of a different diameter,
- a handle attached at one end of the plate,
  - the handle oriented at a low angle in relation to the plate so that a user may rest a hand member on the structure to steady the tool while guiding filler material,
- the plate includes a portion which is curved in the longitudinal direction of the tool to permit positioning of the tool on a curved surface during use,
- the portion of the plate which is curved in the longitudinal direction of the tool is substantially convex in relation to the position of the handle,
- the holes are arranged in a row longitudinally of the plate, and
- the holes are axially perpendicular to a tangential surface of the plate and have a wider diameter at the bottom of the plate than at the top of the plate.

6. A tool for guiding filler material into an opening in a structure as described in claim 5, wherein
- a row of holes includes a smallest hole near a first end of the plate and progressively larger holes toward a second end of the plate.

* * * * *